US007140973B2

(12) United States Patent
Rohrer

(10) Patent No.: US 7,140,973 B2
(45) Date of Patent: Nov. 28, 2006

(54) PUTTER GRIP WITH IMPROVED VIBRATION TRANSMISSION TO HANDS

(75) Inventor: John W. Rohrer, York, ME (US)

(73) Assignee: Rohrer Technologies, Inc., York, ME (US)

( * ) Notice: Subject to any disclaimer, the term of this patent is extended or adjusted under 35 U.S.C. 154(b) by 0 days.

(21) Appl. No.: 10/731,332

(22) Filed: Dec. 8, 2003

(65) Prior Publication Data

US 2004/0121850 A1 Jun. 24, 2004

Related U.S. Application Data

(60) Provisional application No. 60/435,406, filed on Dec. 20, 2002.

(51) Int. Cl.
*A63B 53/14* (2006.01)

(52) U.S. Cl. ..... 473/300; 473/301; 473/318

(58) Field of Classification Search ..... 473/300–303, 473/316, 318, 212, 219, 226, 508, 549, 551; D21/756, 758; D08/DIG. 6–8; 74/551.9; 81/489–492; 16/421, 430; 280/821
See application file for complete search history.

(56) References Cited

U.S. PATENT DOCUMENTS

| | | | | | |
|---|---|---|---|---|---|
| 3,318,602 | A * | 5/1967 | Kunihisa | ..... | 473/232 |
| 4,819,939 | A * | 4/1989 | Kobayashi | ..... | 473/299 |
| 5,261,665 | A * | 11/1993 | Downey | ..... | 473/303 |
| 5,575,473 | A * | 11/1996 | Turner | ..... | 473/298 |
| 6,007,431 | A * | 12/1999 | Bloom, Jr. | ..... | 473/292 |

* cited by examiner

*Primary Examiner*—Stephen Blau

(57) ABSTRACT

A putter or other golf club grip has rigid vibration transmitting protrusions either attached to the club shaft or in intimate contact with both the shaft and the golfer's hands, areas between said protrusions optionally being filled with conventional grip materials. The grip may be placed over existing club shafts like conventional slip-on or wrap-on grips or become an extension thereof. The grips may be attached and weighted in such a manner to further enhance desirable impact vibrational feedback to a golfer's hands further improving a golfer's distance control while reducing off center hits and the resulting distance and directional loss.

15 Claims, 5 Drawing Sheets

PUTTER GRIP WITH IMPROVED VIBRATION TRANSMISSION TO HANDS

CROSS REFERENCE TO RELATED APPLICATIONS

Applicant claims benefit of the filing date of Provisional Application No. 60/435,406, filed on Dec. 20, 2002.

References Cited

U.S. Patent Documents

| | | | |
|---|---|---|---|
| 4,979,743 | December 1990 | Sears | 273/81R |
| 5,261,665 | November 1993 | Downey | 273/81B |
| 5,269,518 | December 1993 | Kobayashi | 273/81A |
| 5,465,967 | November 1995 | Beockenhaupt | 273/162R |
| 5,511,790 | April 1996 | Duran | 473/201 |
| 5,575,473 | November 1996 | Turner | 473/298 |
| 5,588,921 | December 1996 | Parsick | 473/299 |
| 5,653,644 | August 1997 | Jaeckel | 473/303 |
| 5,795,242 | August 1998 | Ree | 473/303 |
| 5,897,440 | April 1999 | Bae et al. | 473/201 |
| 5,964,670 | October 1999 | Cheng | 473/319 |
| 5,993,327 | November 1999 | Terril | 473/297 |
| 6,007,413 | December 1999 | Bloom | 473/292 |
| 6,123,625 | September 2000 | Koblenz | 473/203 |
| 6,251,027 B1 | June 2001 | Buchanan | 473/300 |

Foreign Patent Document

| | | |
|---|---|---|
| 2,202,319 | September 1988 | (GB) |

BACKGROUND OF THE INVENTION

Golf club grips have evolved over the past two centuries toward the objective of better absorption of impact shocks and vibrations. This has become especially important with the advent of steel shafts with superior shock transmission to the wood shafts which preceded them. Steel shafts with internal shock and vibration absorbing elastomers have become popular in recent years. Graphite and other composite shafts have also gained popularity for their better shock absorption properties (and their reduced weight).

Putter grips have historically been of similar construction as full swing grips. The Rules of Golf (promulgated by the U.S. Golf Association or USGA) allow putter grips to have non-circular cross sections, unlike full swing club grips. They are often, therefore, larger or thicker in some sections than full swing club grips and hence even more shock or vibration absorbing.

Distance control is a vital part of effective putting. Essential feedback for determining the proper putterhead velocity for a given length putt is primarily gained through impact shock and vibration felt in a player's hands during prior putts of various lengths and slopes. Full swing club type grips with their excellent shock and vibration absorbing qualities are, therefore, very poorly suited for putters and other clubs, such as wedges and chipping clubs, used primarily for low impact shorter distance and partial swing shots. Maximum impact transmission to the golfer's hands is desirable here. Many novice golfers choose putters with "dead" grips, shafts and even polymer putterhead face impact inserts because they absorb and dampen harsh vibrations caused by impacting a ball away from the putterhead center of gravity (the "sweet spot"). Accomplished players, who hit the "sweet spot" more reliably, prefer metal faced putterheads for enhanced impact vibrational transmission to their hands (plus enhanced acoustical feedback). Unfortunately, conventional putter grips made like full swing club grips create a vibration transmission barrier between the putter shaft (usually steel) and the player's hands reducing or eliminating the vital vibrational feedback needed for distance control, or to tell a golfer he is missing the "sweet spot" of the putterhead (which causes an unintended loss of distance and directional control).

SUMMARY OF THE INVENTION

The present invention describes a grip for putters and other less than full swing clubs with enhanced impact vibration transmission from the club shaft to the hands via the use of rigid vibration transmitting protrusions attached to, in intimate contact with, or integral with the clubshaft and contacting the player's hands. Most embodiments allow the improved grips of the present invention to replace the conventional slip-on, or wrapped grips found on most putters and other clubs today. Some described embodiments of the present invention enhance impact vibrations in the vicinity of one or both of a player's hands on said grip via unique mounting and/or weighting of the grip and nearby shaft.

One object of the present invention is to provide a putter or other golf club grip with enhanced vibration transmission for better impact feedback between the putter shaft and the player's hands.

Another object of the present invention is to increase or amplify the impact vibrations transmitted to said grip via grip mounting and/or backweighting techniques.

A third object of the present invention is to provide the said grip of said present invention in such form that it can be used on new or existing putters and other clubs with conventional steel or composite shafts.

DISCUSSION OF THE PRIOR ART

Golf club grips including almost all putter grips have traditionally been made to absorb, not enhance, or transmit impact vibrations to a player's hands. This is desirable for full swing clubs due to the harsh vibrations created when impacting a ball at clubhead speeds ranging from 35 mph to 135 mph. It is undesirable, however, for putters and other partial swing clubs where the magnitude of impact vibrations are typically an order of magnitude less and the object is distance control not maximum distance.

Cheng (U.S. Pat. No. 5,964,670) describes multiple rigid projections, attached to or integral with the golf shaft, like the present invention, but his projections are shaped and located to dampen, not transmit, or enhance impact vibrations on full swing clubs, not putters. Also, he describes a conventional leather or elastomer grip covering such projections. They are not in contact with the player's hands as is the present invention.

Downey (U.S. Pat. No. 5,261,665) describes a two piece grip, again for full impact clubs not putters, with an inner core material generally stiffer than the outer material with projections from the core material protruding to, or near the grip surface. The sole purpose and design of Downey's grip is to increase the tortional rigidity of the grip to improve the angular accuracy of full swing clubs. Despite the stiffer core, every attempt is made to preserve maximum vibration absorption in the grip. Both core and cover materials, theroplastic rubber, are vibration absorbing, not conducting materials.

Bae (U.S. Pat. No. 5,897,440) describes a grip produced by inserting numerous elastomer grommets, or "nodules"

into holes in the upper end of the golf shaft with the objects of lighter weight and easier installation and replacement. The subject grip is almost the inverse of the present invention with soft energy absorbing protrusions contacting the hands vs. rigid vibration conducting protrusions.

Jaeckel (U.S. Pat. No. 5,653,644), Buchanan (U.S. Pat. No. 6,251,027 B1), and perhaps others propose all metal putter grips where the grip is an integral part of the shaft, not a grip fitted to new or existing traditional putter shafts like the present invention. Jaeckel describes a shaft stiffer than conventional steel putter shafts (he proposes use of aluminum for stiffness, but aluminum is not as stiff as steel?). He also describes and claims a very wide "D" shaped grip (over 0.93 inches) to "keep the golfer's wrists from breaking." He does not describe or claim enhanced vibration transmission. The grip has a "textured" (sand blasted) finish to increase adhesion, but lacks any protrusions to concentrate vibrational feedback to the hands while reducing the cold or wet (clammy) feel of metal surfaces against the hands. Buchanan describes an unconventional round, oversized (over 25 mm), untapered putter shaft wherein "part of the bare shaft forms the grip." It differs substantially from the present invention for the reasons described in Jaeckel above.

Parsick (U.S. Pat. No. 5,588,921), Terril (U.S. Pat. No. 5,993,327), and Koblentz (U.S. Pat. No. 6,123,625) all propose similar metal paddle handle type putter grips integral with, or rigidly attached to, the putter shaft. None describe or claim enhanced vibrational transmission to the hands per the present invention. None have multiple, rigid transmitting projections like the present invention. Impact vibration transmission in all three is diminished by the reduced contact surface between the golfer's hands and the paddle or leaf shaped handle. '327 and '625 describe and claim unconventional hand placement suited to their paddle grips.

Ree (U.S. Pat. No. 5,795,242) describes a golf grip (not primarily for putters) with multiple protrusions from the grip surface. All the protrusions contain magnets (for health reasons). The magnets are covered by a soft resilient layer. There is no rigid conducting path between the shaft and the golfer's hands as in the present invention.

Turner (U.S. Pat. No. 5,575,473) describes a resilient elastomer covered (no rigid conducting pathway to hands) grip for full swing clubs (not putters) with an inner rigid tube which loosely slips over conventional club shafts and is attached at the butt end and one other connecting point via a rigid connecting collar producing an enclosed inner cavity (between collar and butt) and an open cavity (collar to grip bottom). Varying the collar location varies grip "feel and sound" upon impact, again with full swing clubs.

Sears (U.S. Pat. No. 4,979,743) proposes a two cavity putter grip geometrically similar to '473 previously described, but with a single mounting point on the putter shaft at a mode of minimum impact vibration (typically 3" to 6" from grip top on conventionally weighted, gripped and shafted putters). The mount uses a resilient elastomer. The mounting material and mounting location minimizes vibration transmission from the shaft to the hands, the exact opposite of the present invention.

Kobayashi (U.S. Pat. No. 5,269,518), Boeckenhaupt (U.S. Pat. No. 5,465,967), Bloom (U.S. Pat. No. 6,007,431), and others, describe and claim backweighting means for putters and other clubs. Backweighting putter grips has been practiced for decades. None describe or claim backweighting such that shaft and grip vibration amplitude and transmission is maximized at one or both hands for improved impact feedback.

DESCRIPTION OF PREFERRED EMBODIMENTS

Figure 1:
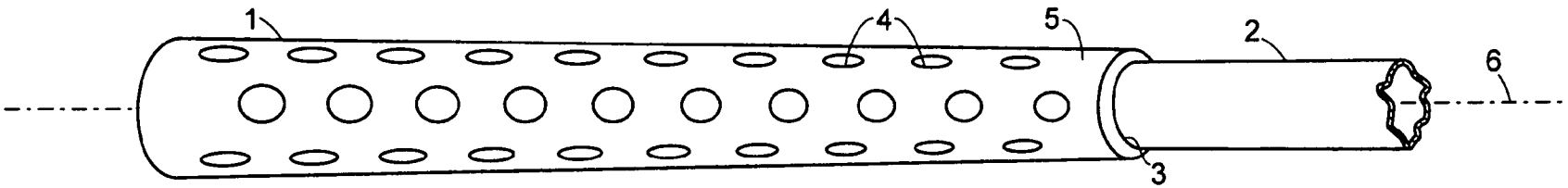
FIG. 1 is a side perspective of a putter or other club grip of the present invention fitted over (slip-on type) a conventional steel or composite club shaft.

Preferred embodiments of the present invention utilize one or more metal, rigid plastic, ceramic or other vibration transmitting elements attached to, in intimate contact with, or integral with a conventional putter shaft or other club shaft at least some of said elements also contacting a player's hand or hands providing improved vibrational feedback upon clubhead impact with a ball. FIG. 1 shows a perspective view of one embodiment of a putter or other club grip 1 of the present invention, as well as, a portion of the club shaft 2 with central axis 6 on which club shaft is mounted a grip of the present invention via a thin layer of adhesive or conventional solvent activated grip tape 3 or pre-applied adhesive in the grip bore, at the juncture of said grip 1 and shaft 2, and continuing toward part or all of the length of said grip. Multiple small vibration conducting protruding elements 4 in contact with the shafts 2 or said grip mounting adhesive layer 3 protrude to or through said grip surface 1. The areas 5 between said protruding elements 4 may be filled or unfilled with resilient elastomers, leather, or other conventional grip materials. For putters, said grip surface may be of varied sections, such as circular (shown) or "D", rectangular, hexagonal, or other shapes (not shown), according to the USGA Rules of Golf. For non-putters, only circular sections are allowed. All USGA allowed grip shapes are within the scope of the present invention.

Figure 2C:
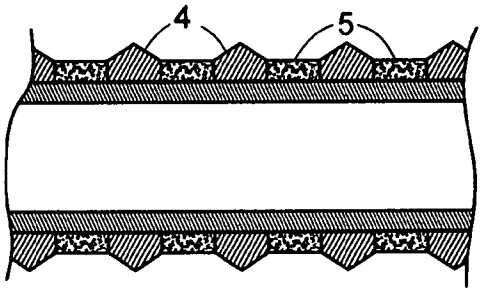
FIG. 2 shows partial sections, parallel to and through the club shaft center axis, of three embodiments of the present invention in which numerous small rigid vibration conducting elements are either of uniform dimension in both the axial and circumferential directions, or elongated in the circumferential direction. A and B show areas between the projections filled or unfilled, respectively, with a resilient elastomer. In C, said projections protrude above said resilient layer surface and are pointed.
Figure 2B:
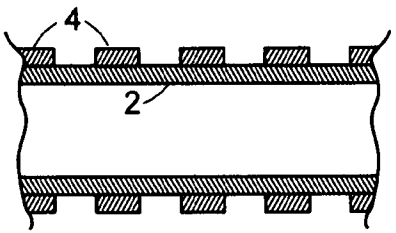
Figure 2A:
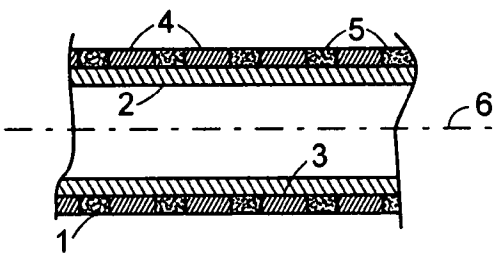

FIG. 2 shows three sectional views through and parallel to shaft axis 6. In A, said protrusions 4 in intimate contact with the shaft 2 outer surface or said adhesive layer or tape 3, protrude to the surface of said grip 1. Resilient elastomer, leather or the like, fills areas 5 between said elements 4 and is flush with the top surface 1 of said elements 4. In B, said resilient elastomer is not used and said elements 4 are either part of said shaft 2 or welded, brazed, soldered, adhesive bonded, or otherwise fused to it. In C, said elements protrude above any resilient layer 5, if used, and may be pointed (as shown), flat or rounded in section (not shown). Said elements may be of uniform axial and circumferential dimension or elongated (ring or partial ring) in circumferential dimension.

Figure 3C:
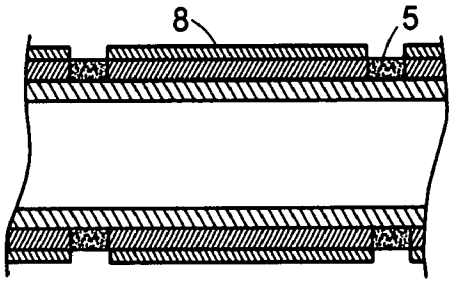
FIG. 3 shows three partial sections, parallel to and through the club shaft center axis, of three different embodiments of the present invention where said projections are elongated in the axial direction, again with areas between filled flush, unfilled, and partially filled, respectively.
Figure 3B:
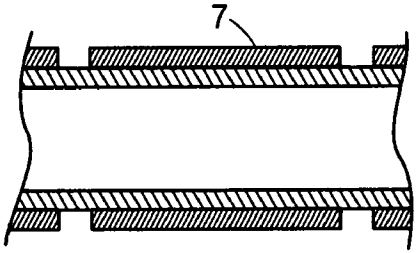
Figure 3A:
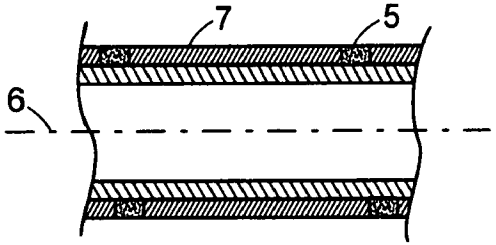

FIG. 3 shows three sectional views through and parallel to the shaft axis 6. In A, said protruding elements 7 are elongated in the axial dimension (shown) or circumferential direction (not shown). In FIG. 3B, as in 2B, no resilient layer between elements is used and elements are affixed as in 2B. In 3C, the elongated elements 8 have a single pointed crown (shown), or multiple pointed crowns (not shown), or rounded crowns (not shown) to enhance vibration transmission to a player's hand. Said elements 8 may protrude above said resilient layer 5 if used.

Figure 4B:
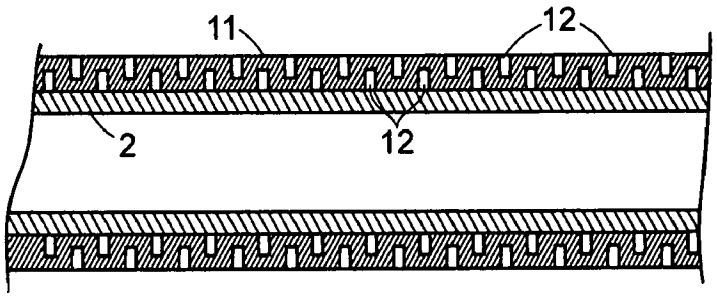
FIG. 4 shows two partial sections, parallel to and through the club shaft center axis, where said radially protruding elements are substantially longer and oriented parallel to the shaft axis, said elements having either holes (A) or cracked edges (B), or similar means to increase flexibility to facilitate "slip-on" installation of said grips and/or to improve the integrity of said resilient elastomer layer surrounding said elements.
Figure 4A:
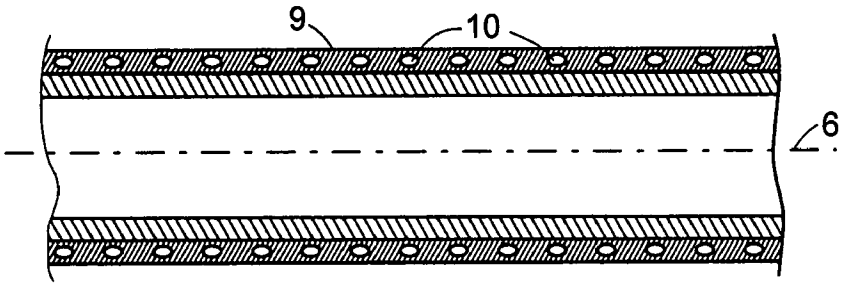

FIG. 4 shows elongated elements 9 of the subject invention with multiple through holes 10 for the purpose of more securely bonding said elements 9 to any said resilient layer between them, said resilient layer flowing through said holes 10 when said grip is cast or molded. In 4B, said elements 11 have the upper and/or lower edge cracked with gaps 12 allowing said resilient layer to flow through said gaps improving the integrity of said grip and providing more flexibility within said elongated elements 11, providing more intimate contact with said shaft 2 and making "slip-on" installation of said grips easier.

Figure 5:
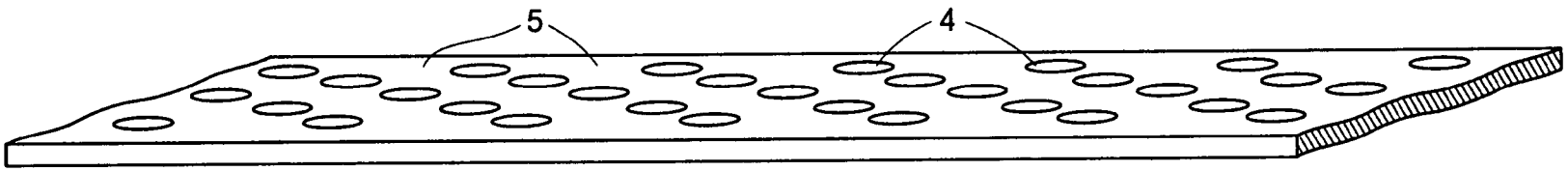
FIG. 5 shows an uninstalled strip of leather, elastomer, or flexible laminate of conventional dimensions for spiral wrapped-on grips, but with embedded elements of the present invention.

FIG. 5 shows a perspective view of a grip (not installed) of the present invention with said protrusions 4 embedded in said resilient layer 5 and configured as a spiral "wrap-on" type grip.

Figure 6B:
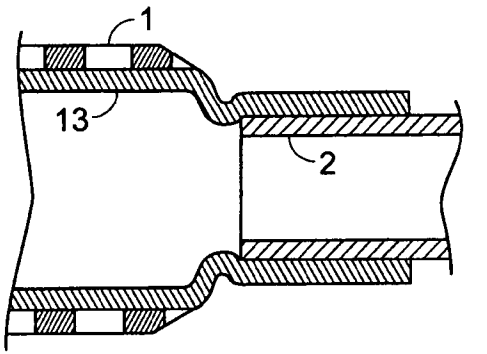
FIG. 6 shows three partial sections, parallel to and through the club shaft center axis, of the lower end of a grip of the subject invention which has been mounted on a rigid tube, which tube is brazed, soldered, shrunk fit or adhesively bonded to the inside (A), or outside (B) and (C) of a shortened conventional club or putter shaft.
Figure 6C:
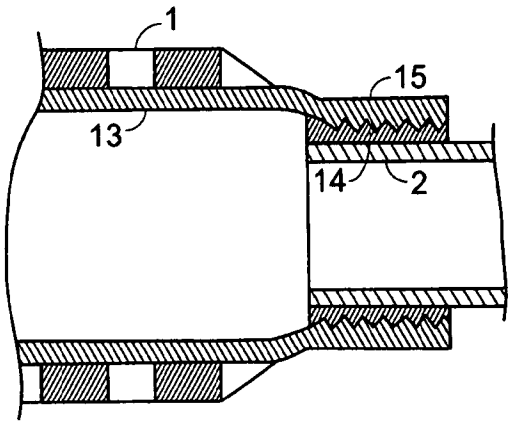
Figure 6A:
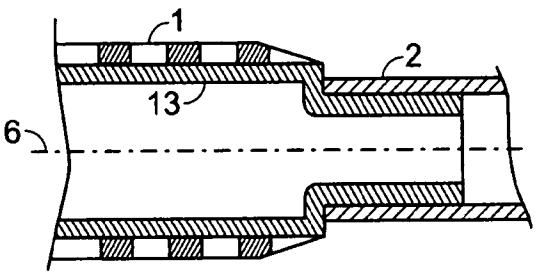

FIG. 6 shows three sectional views through and parallel to the shaft axis 6. The grip of the present invention is mounted on a metal, or other rigid tube 13, which is securely inserted and affixed into 6A or onto 6B, a conventional shaft 2, optionally shortened by approximately the length of said grip. In 6C, a threaded collar 14 or other mechanical attachment means is securely affixed to said shaft 2 with mating threads 15 or other attachment means on said grip extension tube 13.

Figure 7B:
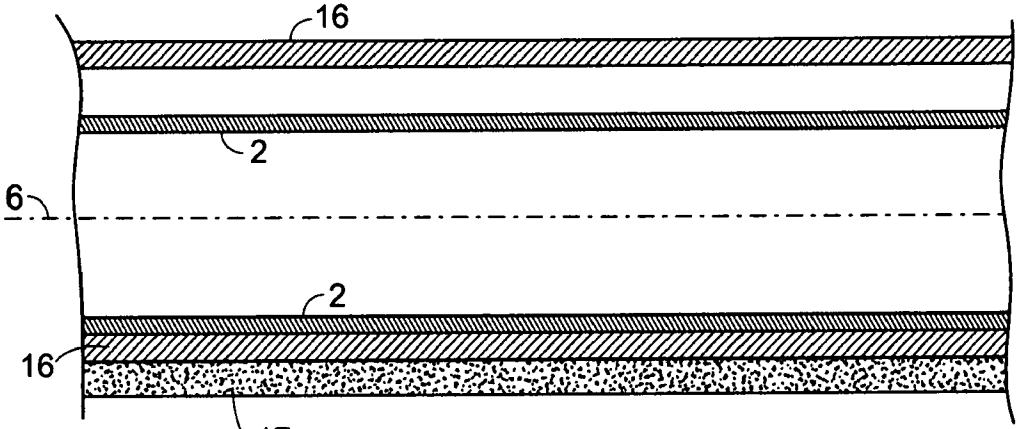
FIG. 7 shows a sectional view transverse to the shaft axis (A) and a section parallel to and through said shaft axis (B) of an embodiment of the present invention where a single thin walled conducting element of the present invention has multiple radially oriented folds with optional resilient elastomer between the exterior side of said folds.
Figure 7A:
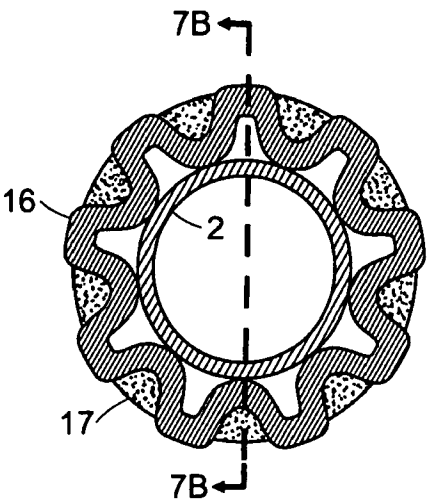

FIG. 7 shows a sectional view A transverse to said shaft axis 6 and a section A—A in FIG. 7B through and parallel to shaft axis 6. A single convolute element 16 with multiple folds parallel to axis 6 is in intimate contact with said shaft 2 outer surface which folds extends outward generally radially from said shaft axis 6. The areas between said folds may optionally be filled with said resilient material 17. Said folds allow "slip-on" installation of said grip, expanding slightly as said folds flex while maintaining intimate contact with said shaft 2 with or without supplemental bonding of said element 16 to said shaft 2.

Figure 8:
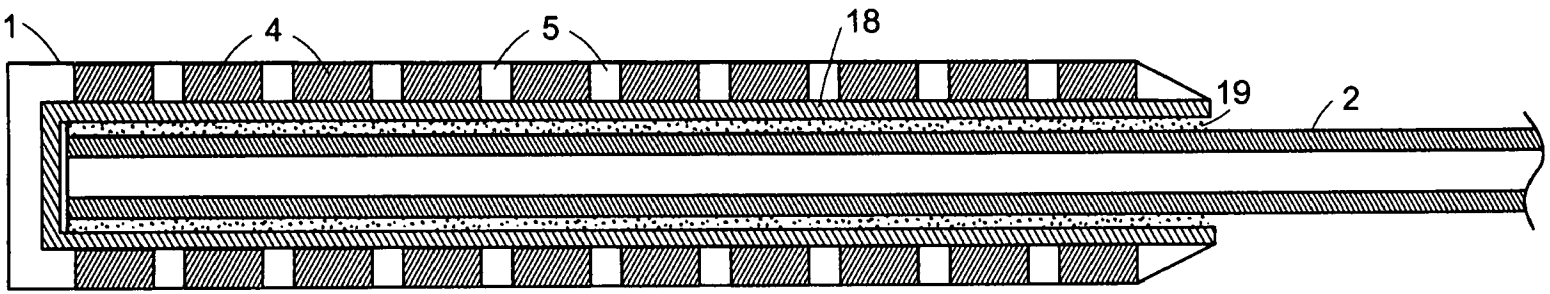
FIG. 8 is an axial section of a grip of the present invention mounted on a rigid tube into which is inserted a conventional putter or golf shaft and rigidly retained by adhesive or friction-fit along part or all of the interface between said shaft and said tube.

FIG. 8 shows a sectional view through and parallel to said shaft axis 6 with a grip 1 of the present invention mounted on a metal, ceramic, rigid plastic, or otherwise rigid tube 18 with an inside diameter approximately equal to, or slightly larger than, the outside diameter of said shaft 2 over which said tube 18 is placed. Said tube 18 can be intimately affixed to said shaft 2 either via an adhesive layer 19, or a tight mechanical or shrink fit (not shown). In one embodiment (not shown), the tube 18 and the elements 4 are integral with each other and cast or molded of metal, ceramic, or rigid plastic.

Figure 9:
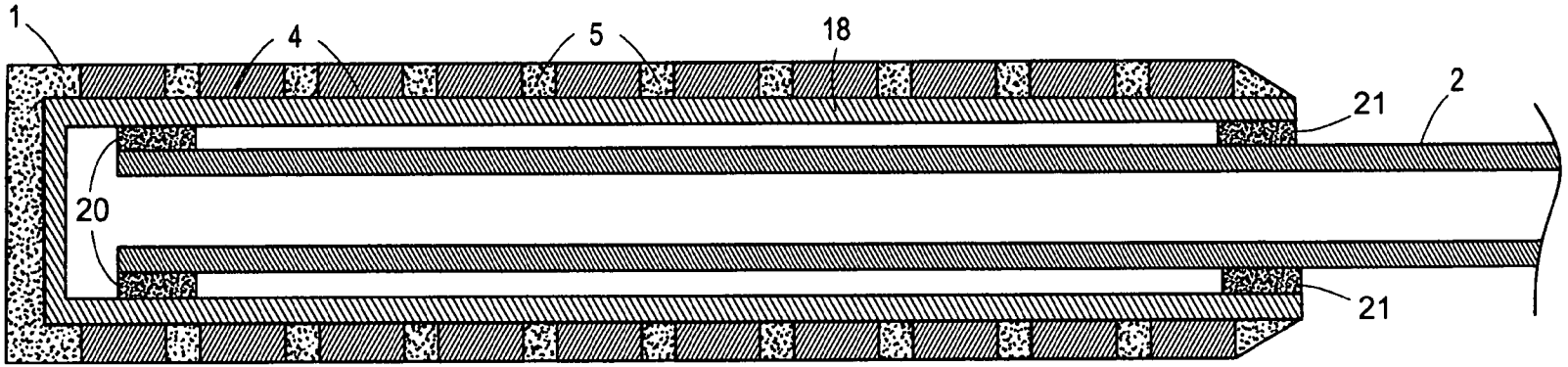
FIG. 9 is an axial section of a grip of the present invention mounted on a rigid tube placed over a conventional putter or club shaft and rigidly retained via adhesive or friction-fit on one or both ends of said grip with tube.

FIG. 9 shows a sectional view through and parallel to shaft axis 6 of an embodiment of the present invention where said grip 1 with protruding elements 4 and optional resilient material 5 are mounted on a rigid tube 18 as in FIG. 8 previously described. Said tube 18 is firmly attached to said club shaft 2 at one or two points 20 and/or 21 in such a manner as to enhance impact vibration transmission conducted from said shaft 2 to the surface of said grip 1 in those areas where one or both of a player's hands contact said grip, impact vibrations being greater at locations 20 and/or 21 than locations in between.

Figure 10:
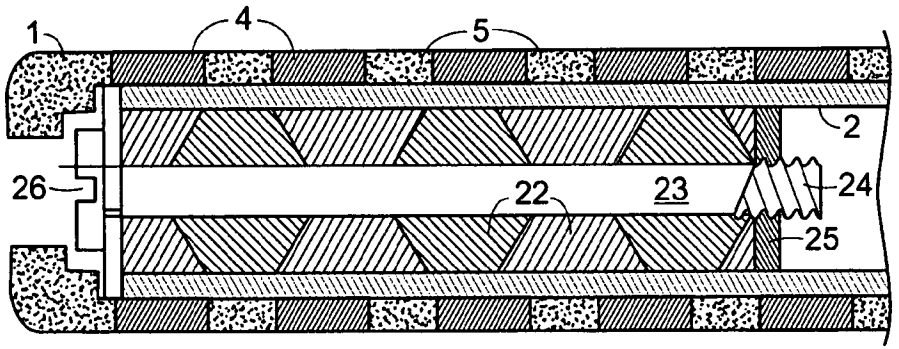
FIG. 10 is a partial butt end axial section of a grip of the present invention mounted over a conventional shaft, the butt end of which is weighted to relocate the areas of shaft maximum and minimum vibrational amplitude upon club impact with a ball.

FIG. 10 shows a sectional view through and parallel to shaft axis 6 of an embodiment of the present invention where said grip 1 is mounted on said shaft 2 via any of the means previously described. Internal to said shaft 2 is a weighting means 22 firmly affixed to the inside butt end of said shaft 2 or said grip via adhesive (not shown) or mechanical means (shown), such as nesting expandable compression collars 22 compressed with a tension bolt 23 with threads 24 using a threaded nut or collar section 25 and bolt turning means 26, or other weight attachment means. Said weights 22 are selected and positioned to relocate shaft transmitted impact vibrations along the shaft length such that these feedback vibrations are increased at the location of one or both of a player's hands on said grip. Such vibration enhancing means can be combined with those previously described in FIG. 9, previously described for added enhancement.

Persons skilled in the art will appreciate that modifications and alterations of the embodiments described herein can be made without departing from the spirit, principles, or scope of the present invention. The illustrated and described embodiments must be understood as being shown only for the purposes of examples and not by way of limitation of the invention as defined in the following claims.

What is claimed is:

1. A putter or other golf club grip, for placement at one end of a golf club shaft having a club head at the other end, said grip including a plurality of individual hard or rigid vibration transmitting elements wherein each element is adhered to or in direct contact with said shaft, wherein each element is not adhered to or not in direct contact with any other of said element, some or all of said elements are able to contact a golfer's hand or hands, said elements being selectively positioned within said grip at those locations where transmission of vibrations are desirable and omitted at those locations where vibrations are not desirable, wherein the grip area around said elements is comprised of a layer of one or more softer or energy absorbing grip materials adhered to or in direct contact with said shaft which at least partially is able to insulate from a golfer's hands or absorb said undesirable vibrations, and at least one element is located completely away from longitudinal ends of said grip.

2. The grip of claim 1 where the elements are of circular, square, hexagonal, or other symmetrical shape in a sectional plane parallel to a shaft axis or elongated semi-circular or ring shaped in circumferential dimension.

3. The grip of claim 1 where the elements are of rectangular, oval, or other elongated shape in a sectional plane parallel to a shaft axis with the longitudinal axis of said elements parallel to said shaft axis or elongated semi-circular or ring shaped in circumferential dimension.

4. The grip of claim 1 wherein each element is integral with or rigidly attached to said shaft prior to casting, molding, or otherwise placing said softer grip materials around said elements.

5. The grip of claim 1 with said grip or said shaft backweighted within four inches of a top with lead, tungsten, or other high density material in such manner and proportion to increase shaft impact vibration to said elements proximate to a golfer's hand position on said grip.

6. A putter or other golf club grip, for placement at one end of a golf club shaft extension wherein said shaft extension is able to substantially increase the length of a golf club shaft, said grip including a plurality of individual hard or rigid vibration transmitting elements wherein each element is adhered to or in direct contact with said shaft extension, wherein each element is not adhered to or not in direct contact with any other of said element, some or all of said elements are able to contact a golfer's hand or hands, said elements being selectively positioned within said grip at those locations where transmission of vibrations are desirable and omitted at those locations where vibrations are not desirable, wherein the grip area around said elements is comprised of a layer of one or more softer or energy absorbing grip materials adhered to or in direct contact with said shaft extension which at least partially is able to insulate from a golfer's hands or absorb said undesirable vibrations, and at least one element is located completely away from longitudinal ends of said grip.

7. The grip of claim 1 or 6 where said elements are metal, ceramic, or plastic having a modulus of elasticity substantially higher than rubber, urethane, leather, or other common softer grip materials.

8. The grip of claim 1 or 6 where said elements are embedded in or inserted through the softer rubber, urethane, leather, or other common grip material.

9. The grip of claim 1 or 6 where said grip is of the slip-on type.

10. The grip of claim 1 or 6 where said grip is of the wrap-on type.

11. The grip of claim 1 or 6 where said elements are flush with the surface of said softer grip materials.

12. The grip of claim 6 where the elements are circular, square, hexagonal, or other symmetrical shape in a sectional plane parallel to a shaft extension axis or elongated semi-circular or ring shaped in circumferential dimension.

13. The grip of claim 6 where the elements are of rectangular, oval, or other elongated shape in a sectional plane parallel to a shaft extension axis with the longitudinal axis of said elements parallel to said shaft extension axis or elongated semi-circular or ring shaped in circumferential dimension.

14. The grip of claim 6 wherein each element is integral with or rigidly attached to said shaft extension prior to casting, molding, or otherwise placing said softer materials around said elements.

15. The grip of claim 6 with said grip or said shaft extension backweighted within four inches of a top with lead, tungsten, or other high density material in such manner and proportional to increase shaft extension impact vibration to said elements proximate to a golfer's hand position on said grip.

* * * * *